United States Patent [19]

Jarmy

[11] 4,354,724

[45] Oct. 19, 1982

[54] CIRCUIT BOARD CONNECTOR INDEXING KEY

[75] Inventor: Howard I. Jarmy, San Francisco, Calif.

[73] Assignee: The Singer Company, Binghamton, N.Y.

[21] Appl. No.: 174,079

[22] Filed: Jul. 31, 1980

[51] Int. Cl.[3] ..... H01R 13/645

[52] U.S. Cl. ..... 339/186 R; 339/186 M

[58] Field of Search ..... 339/186 R, 186 M, , 339/184 R, 184 M, 176 MP

[56] References Cited

U.S. PATENT DOCUMENTS

| | | | |
|---|---|---|---|
| 2,935,725 | 5/1960 | Fox | 339/176 MP |
| 2,983,896 | 5/1961 | Gilbert | 339/184 M |
| 3,573,711 | 4/1971 | Henschen | 339/184 M |
| 3,930,706 | 1/1976 | Obuch et al. | 339/176 MP |
| 3,975,076 | 8/1976 | Shida et al. | 339/184 M |

FOREIGN PATENT DOCUMENTS

| | | | |
|---|---|---|---|
| 924017 | 4/1963 | United Kingdom | 339/184 M |

*Primary Examiner*—John McQuade

*Attorney, Agent, or Firm*—Jeff Rothenberg; Stephen C. Kaufman

[57] ABSTRACT

An improved indexing key (40) for use with a circuit board connector strip (10) of the type having an elongate opening (12) for receiving the end of the circuit board and having indexing slots (22) along the top thereof spaced at predetermined intervals for receiving such indexing keys, the improved key being capable of bearing the force of the end of a circuit board being forced against it by way of compression instead of shear.

1 Claim, 7 Drawing Figures

CIRCUIT BOARD CONNECTOR INDEXING KEY

The Government has rights in this invention pursuant to Contract F33657-77-C-0176 awarded by the Department of the Air Force.

TECHNICAL FIELD

The present invention relates to circuit board connector strips and more particularly relates to indexing keys for such connector strips for keyably interrelated circuit boards and connector strips.

BACKGROUND ART

Circuit boards are in widespread use throughout the electronics field. As is well known, a circuit board comprises a flat board of insular material on at least one side of which is bonded a thin layer of conductor which is typically etched to some desired conductor configuration which interconnects a number of electronic parts which are mounted thereon.

Electrical access to such boards takes a variety of forms. Where only a small number of access points are required such access may be by means of small pins which are mechanically bonded to the board and which are electrically connected to the conductor at the desired point.

Modern circuit boards, however, particularly those utilized in connection with advanced and sophisticated technology, may require electrical access to numerous points on a particular board. For example, digital electronic systems may be constructed of a number of boards on which are mounted a dozen or more integrated circuit chips, each such chip containing an intricate circuit comprised of a very large number of electrical components. A single board may thus contain a vastly complex circuit or number of circuits which may require access to a very large number of points.

One way such multiple electrical access is effected, and at the same time conveniently insertable and removable mechanical support for the circuit board is provided, is by means of circuit board connector strips. These connector strips typically take the form of long, hollow, plastic constructions having a long, slot-like opening for receiving the end of a circuit board. The strips are mechanically connected to a support board, sometimes referred to as the "mother board".

Within the connector construction may be placed a series of contiguous chambers, separated by divider walls. These chambers are adapted to receive resilient conductive contacts such that when the end of a circuit board is inserted into the opening of the connector strip the resilient conductors come into contact with one or both sides of the board.

The circuit board, in turn, has etched thereon at the insertion end a linear series of conductive "islands" which, when the board is so inserted, provide the electrical contact surface for the resilient connectors disposed within the chambers of the connector strip.

As is well-known, the above-described arrangement provides a convenient, low-cost and effective means for connecting circuit boards having large numbers of electrical access points to the electrical system within which it functions. It also provides easy insertion and removal of the board for ease of system construction and of maintenance.

Problems can arise, however, with the use of such an arrangement. For example, highly sophisticated and complex electronic systems may require that several, or many such boards be utilized to make up the entire system. Typically in such cases, the mechanical configuration of this system is designed to utilize space with maximum efficiency. This results in the connector strips being placed in fairly close proximity. In addition, because of the identical appearance of integrated circuit packages, and their typically ordered, linear arrangement on such circuit boards, it becomes possible to mistake one board for another without close and careful inspection. Also, it is possible to simply forget which board goes to which connector.

The consequences, however, of inserting such a board into the wrong connector strip can be disastrous to that board or others. Excessive voltages may be improperly placed on components which, in turn, can cause their destruction. This gives rise to costly troubleshooting and replacement of destroyed parts.

To prevent such occurrences, connector strips are provided with small indexing slots along the edge of the opening of the connector strip. Thin strips of plastic are placed in one or more of these slots to serve as indexing keys. Corresponding grooves are cut into the end of the circuit board to match with the placement of the key or keys. By placing the aligning keys in slots at different locations along the strip, a number of boards/connector strip combinations may be individually keyed to prevent the inadvertent placement of a circuit board in the wrong connector strip.

Certain problems can arise, however, in association with the use of such indexing slots and keys. These problems arise from the very small size of the key. For example, typical dimensions of the cross-section of such a key are of the order of approximately 20 mils by 50 mils. These keys are therefore vulnerable to breaking if sufficient forces are applied to a wrong circuit board being forced into the slot.

In practice, the forces required to insert a circuit board into such a connector strip are considerable due to tolerance variations in the thickness of the board and the width of the connector strip opening, as well as frictional forces with the resilient electrical contacts. In fact, technicians constructing practical systems including such circuit board and connector strip arrangements frequently find it necessary to resort to the use of rubber mallets and the like to get the boards to enter the connector strip opening. In addition, "card extractors" are frequently employed which attach to the physical structure adjacent the end of the connector strips to provide lever action for the insertion and extraction of printed circuit boards. Such extractors are capable of providing insertion and extraction forces of the order of magnitude of 100 pounds. The forces provided by such extractors, and by rubber mallets and the like, are far greater than the minimum necessary to cause the physical destruction of an indexing key such as described above.

As a result, such indexing keys do in fact shatter when an improper circuit board is forced into a connector strip. Not only does this defeat the purpose of the indexing key but the shattered debris of the broken key can lodge in unwanted places and give rise to problems. For example, a piece of broken indexing key might lodge itself between resilient contact and the circuit board thus preventing electrical connection.

The present invention provides an improved circuit board connector strip indexing key which not only fits in the very small indexing slots on circuit board connector strips, but in addition provides sufficient structural strength to avoid shattering and the problems associated therewith.

DISCLOSURE OF INVENTION

Accordingly the present invention provides an improved indexing key for use with a circuit board connector strip of the type having an elongate opening for receiving the end of a circuit board, and also having a series of contiguous locations along the interior thereof at which resilient electrical contacts may be placed for electrical/mechanical contact with an inserted circuit board. The circuit board connector strip with which the indexing key of the present invention is used also has indexing slots along the top thereof placed at predetermined intervals for receiving one or more indexing keys, as well as an associated support surface when mechanically connected to a supporting board.

The improved indexing key of the present invention includes a body which has associated with it at least one key arm which may be inserted in an appropriate indexing slot to provide a keying function. The invention also includes an element integral with the body for causing the insertion force transmitted by the end of a circuit board being inserted to be borne by the body in compression between the support surface and the end of the end of the circuit board.

BRIEF DESCRIPTION OF THE DRAWINGS

FIG. 5 is an orthogonal view of the insertion end of a printed circuit board; while

BEST MODE FOR CARRYING OUT THE INVENTION

Figure 1:
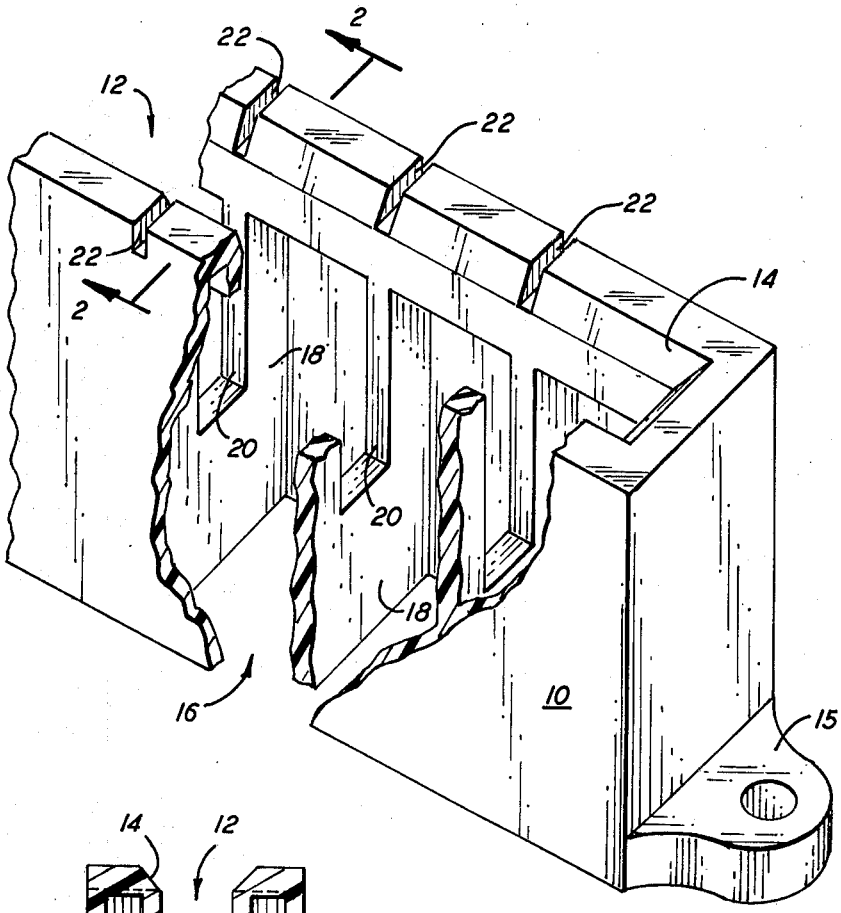
FIG. 1 is a partial cut-away orthogonal view of a printed circuit board connector strip with which the present invention is employed.
Figure 2:
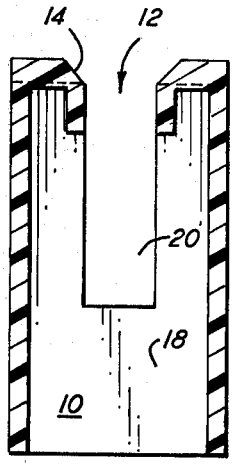
FIG. 2 is a cross-sectional view of the connector strip of FIG. 1.

As was described above, the present invention is utilized in connection with certain types of printed circuit ("P/C") board connector strips. Referring to FIGS. 1 and 2, FIG. 1 is a partial cut-away orthogonal view of the end of such a connector strip, while FIG. 2 is a cross-sectional view of same, along 2—2 of FIG. 1. This strip 10, typically constructed of plastic or other structurally sturdy insulation material, contains an elongate opening 12 along the top thereof for the insertion of the end of a P/C board. The top portion of this strip 10, along opening 12, has beveled surfaces 14 to guide a P/C board into the strip. A mounting lug 15 is provided on each end.

The interior of the strip is divided into a series of chambers 16 divided one from the other by a series of divider walls 18 which have cut-outs 20 to accommodate the inserted printed circuit board and limit the extent of its insertion. The bottom of the chambers 16 are open to allow the insertion of resilient flexible contacts, as will be discussed below. A number of indexing cut-outs 22 are spaced at regular intervals along the top of the strip 10. These cut-outs 22 appear in pairs and are designed to receive the indexing tabs mentioned earlier.

Figure 3:
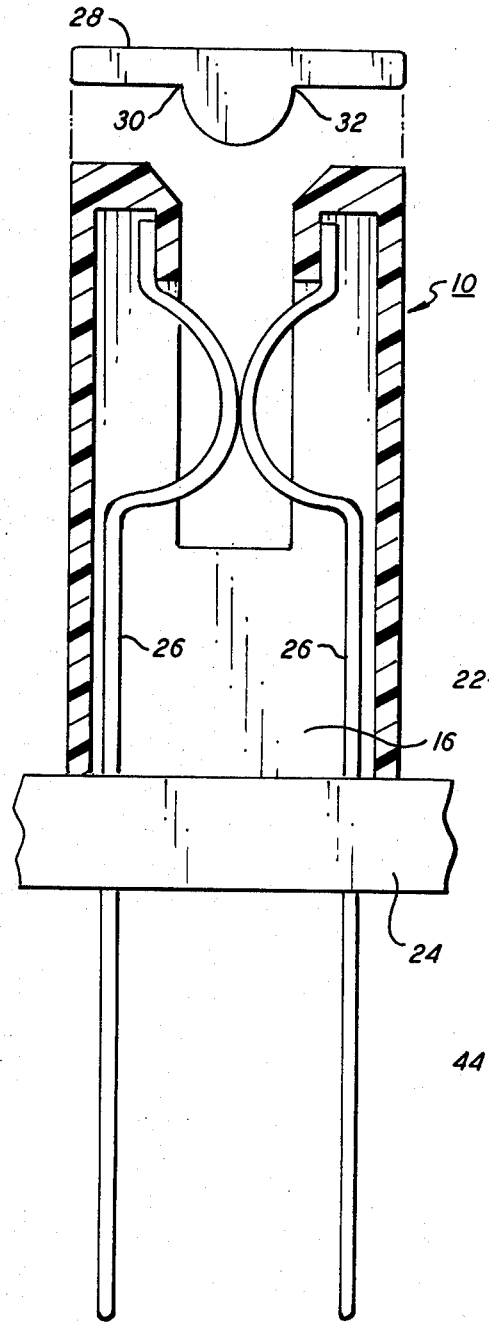
FIG. 3 Prior Art
FIG. 3 is a cross-sectional view of the connector strip of FIG. 1 in place and ready for P/C board insertion, showing a prior art indexing tab to be placed therein.
Figure 4:
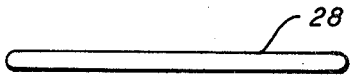
FIG. 4 Prior Art
FIG. 4 is a top view of the prior art indexing tab shown in FIG. 3.

FIG. 3 shows a cross-sectional view of the connector strip 10 in place of a "mother board" 24 having a pair of resilient electrical contacts 26 in place, as shown. An indexing tab 28 of the type found in the prior art may also be seen at the top thereof, as well as in top view in FIG. 4. As was mentioned above, the dimensions of this tab 28 are quite small, the cross-sectional dimensions being of the order of approximately 20 mils by 50 mils. When an improperly keyed circuit board is forced against such a tab 28 shear stresses are created at points 30 and 32. The tabs fail at these points quite readily.

Figure 5:
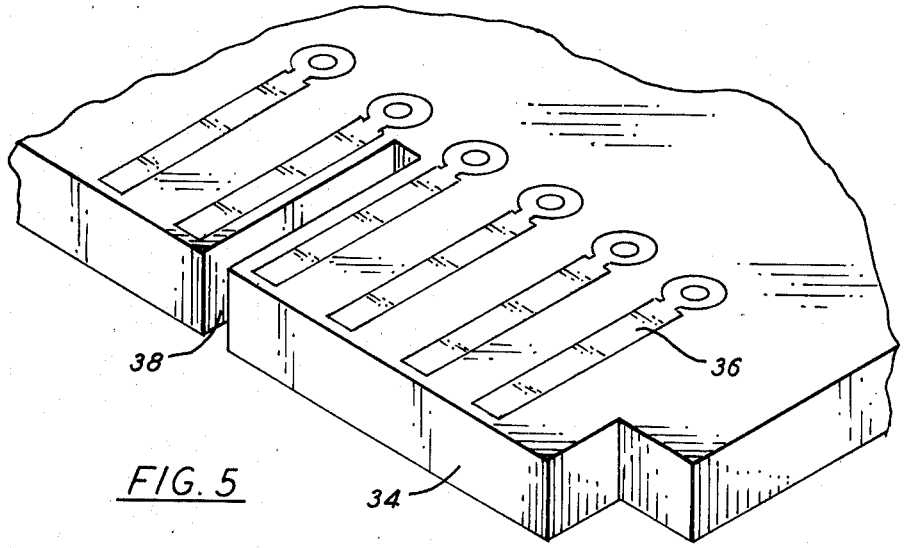

FIG. 5 shows an orthogonal view of the insertion end 34 of a printed circuit board. Small landings 36 of conductive material intended for contact with resilient electrical contacts within the connector strip can be seen in typical linear configuration. Also visible between two of the conductive landings is a cut-out 38 to be lined up with a related indexing key when inserted into its associated connector strip.

Figure 6:
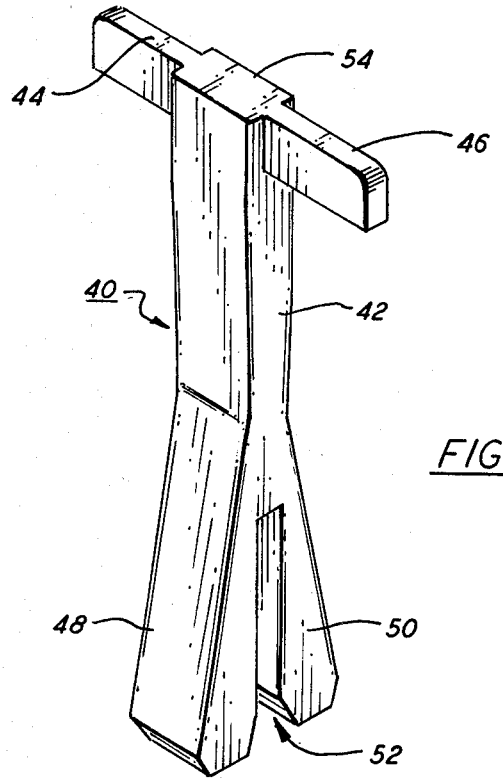
FIG. 6 is an orthogonal view of the preferred embodiment of the present invention.

FIG. 6 shows an orthogonal view of the preferred embodiment 40 of the present invention. As can be seen, it comprises generally an elongate body 42 at the top of which protrude a pair of key arms 44, 46. From the lower portion of the body 42 extend a pair of tapered legs 48 and 50, which define between them a channel 52.

Figure 7:
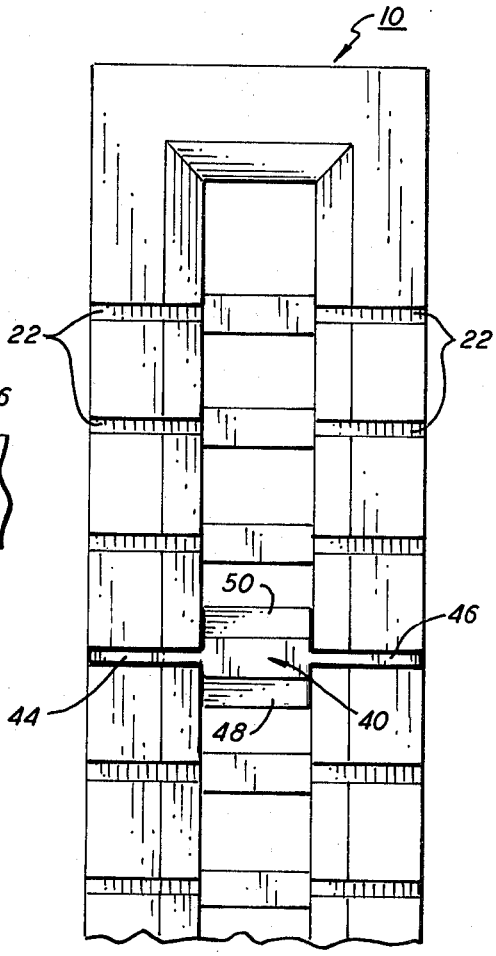
FIG. 7 is a top view of the circuit board connector strip which has inserted therein the preferred embodiment of the present invention.

In practice, the legs 48 and 50 of the key of the present invention are inserted in such a way that they straddle one of the walls 18 of the previously-described connector 10 (see FIG. 1). The key arms 44 and 46 fit into one of the pairs of cut-outs 22 described above. This is illustrated in FIG. 7 which shows the key of the preferred embodiment of the present invention inserted in the connector 10, shown in top view.

The key 40 of the preferred embodiment is dimensioned in such a way that the bottom surfaces of the legs 48, 50 contact the top surface of the mother board 24 (see FIG. 3). The lower portion of the body 42 does not come into contact with the divider wall, nor do the bottom surfaces of the key arms 44, 46 come into contact with the lower surfaces of the cut-outs 22 (see FIG. 1). In this way all of the force brought to bear against the key 40 by the end of a P/C board improperly inserted is borne by the key 40 between the top surface 54 of the key and the bottom surface of the legs 48, 50, in compression. The key arms 44, 46 bear none of the force thus applied, and are therefore subjected to little if any shear force at all.

In the preferred embodiment just described, by virtue of the fitting of the divider wall 18 (FIG. 1) into channel 52, a measure of lateral stability is provided in conjunction with the fitting of key arms 44, 46, into the cut-outs 22.

Any sturdy plastic material may be used to construct the key of the present invention. However, it is recommended that a material having a high flexural modulus and compressive strength be utilized. Exemplary materials, listed in order of preference, are as follows: (a) Glass Filled Polyimide, (b) Bisphenol-A Epoxy, (c) Glass Filled Alkyd, (d) Glass Filled Phenolic, and (e) Glass Filled Polyester.

Dimensions of the key will depend upon the dimensions of the particular connector strip with which it is to be used. Setting dimensions and tolerances is well within the purview of one skilled in the art. Primary considerations are that the thickness of the key be sufficient to provide structural rigidity and compressive strength while permitting the walls of the circuit board cut-out to clear the sides thereof. The lower surfaces of the key arms and of the body 42 should be dimensioned so that no contact is made with the connector.

In fact, it should be clear that it is within the scope of the invention for a key arm to be constructed for a connector strip which does not include chambers separated by divider walls. In such a case it would be unnecessary to provide a channel such as channel 52 shown in FIG. 6, but, rather, some other means would have to be provided to provide lateral stability to the base of the key. Regularly occurring internal features could be utilized to provide a bearing or a support surface to secure the lower portion of the key.

Finally, the mother board need not provide the support surface for the key. For example, some connector strips do not have openings at the bottom, but are instead solid. These connector strips offer a support surface which is integral with the connector itself. Typically this support surface is quite strong relative to the insertion forces which might be applied to a circuit board. Obvious design modification to permit the key to rest on such an internal surface is, once again, well within the purview of one skilled in the art.

Although specific embodiments of the invention have been described herein, it will be obvious to those skilled in the art that various modifications in addition to those set forth herein may be made without departing from the spirit of the invention which is intended to be limited solely by the appended claims.

I claim:

1. An indexing key for use with a circuit board connector strip of the type having an elongate opening for receiving the end of a circuit board, having a series of contiguous locations therealong at which resilient electrical contacts may be placed for electrical/mechanical contact with an inserted circuit board, having indexing slots along the top thereof spaced at predetermined intervals for receiving indexing keys, and having an associated support surface to provide a mechanical connection to a circuit board, the key comprising:

(a) a body dimensioned so as to fit in said elongate opening;

(b) at least one key arm in association with said body for insertable engagement with an indexing slot;

(c) said body comprising an elongate body wherein the bottom of said body is capable of resting on said support surface with said key arm engaged in an indexing slot;

(d) said circuit board connector strip further comprising divider walls separating said contiguous locations within said connector strip wherein said elongate body further comprises a pair of leg portions for straddling one of said divider walls when said key is inserted in place in said connector strip; and (e) means integral with said body for causing said body to bear the force of the end of a circuit board being forced thereagainst by way of compression between said support surface and said circuit board.

* * * * *